US011041369B2

(12) United States Patent
Coyle, Jr.

(10) Patent No.: US 11,041,369 B2
(45) Date of Patent: Jun. 22, 2021

(54) BRUSH ACTUATOR FOR ACTUATING DOWNHOLE TOOLS

(71) Applicant: Bilco Tools, Inc., Houma, LA (US)

(72) Inventor: William E. Coyle, Jr., Houma, LA (US)

(73) Assignee: BILCO TOOLS, INC., Houma, LA (US)

( * ) Notice: Subject to any disclaimer, the term of this patent is extended or adjusted under 35 U.S.C. 154(b) by 0 days.

(21) Appl. No.: 16/083,351

(22) PCT Filed: Mar. 9, 2017

(86) PCT No.: PCT/US2017/021658

§ 371 (c)(1),
(2) Date: Sep. 7, 2018

(87) PCT Pub. No.: WO2017/156322

PCT Pub. Date: Sep. 14, 2017

(65) Prior Publication Data

US 2019/0055820 A1 Feb. 21, 2019

Related U.S. Application Data

(60) Provisional application No. 62/305,848, filed on Mar. 9, 2016.

(51) Int. Cl.
*E21B 37/02* (2006.01)
*E21B 34/14* (2006.01)

(52) U.S. Cl.
CPC ..... *E21B 37/02* (2013.01)

(58) Field of Classification Search
CPC ..... E21B 37/02; E21B 37/00; E21B 17/006; E21B 12/06; E21B 34/14
See application file for complete search history.

(56) References Cited

U.S. PATENT DOCUMENTS 2,654,433 A * 10/1953 Piety ..... E21B 33/124 73/152.36
4,736,627 A * 4/1988 Wicks, III ..... B01D 19/0021 166/303
5,138,876 A * 8/1992 Moore ..... E21B 47/10 166/250.06
2016/0061006 A1* 3/2016 Krueger ..... E21B 37/02 166/174

* cited by examiner

*Primary Examiner* — Catherine Loikith

(57) ABSTRACT

An embodiment of an apparatus includes an actuatable downhole tool with a brush actuator that includes brush elements extending outwardly from a slide member that surrounds a mandrel having a proximal end connectable to a tubular string. The brush elements are sized to engage a casing into which the apparatus is disposed. A spring element is disposed intermediate the slide member and the mandrel to bias the mandrel to a proximal position. A transition mode of the brush elements is achievable by reversing the direction of movement of the apparatus within the casing from the trailing up mode towards the trailing down mode and provides a sufficient amount of resistance to overcome the spring element to move the slide member to a distal position and displace a displaceable member of the actuatable downhole tool to actuate the tool.

20 Claims, 5 Drawing Sheets

BRUSH ACTUATOR FOR ACTUATING DOWNHOLE TOOLS

STATEMENT OF RELATED APPLICATIONS

This application depends from and claims priority to PCT/US2017/021658 entitled Brush Actuator for Actuating Downhole Tools filed on Mar. 9, 2017, which depends from and claims priority to U.S. Provisional Application No. 62/305,848 filed on Mar. 9, 2016.

BACKGROUND

Field of the Invention

The present invention relates to an actuator for actuating downhole tools in a cased well. More specifically, the present invention relates to a brush actuator for actuating a mechanically actuatable downhole tool that is run into a well casing to a targeted interval to perform its intended function.

Background of the Related Art

Brush tools for use in earthen wells are tools that fitted with brush elements and connected to or within a tubular string or work string. A brush tool is introduced into a well and run into a wellbore as the tubular string is extended from the surface. A plurality of brush elements of the brush tool extend radially outwardly from the brush tool to engage and abrade the interior surface of the bore of the casing. A brush tool may include a flow bore connected to the tubular string and through which fluid introduced into the tubular string at the surface can flow. Some brush tools further include jet ports through which fluid can flow from the flow bore radially outwardly to impinge onto the interior wall of the casing to assist in cleaning debris from the well casing. Debris removed from the well casing may be suspended in fluid flow and removed from the well to the surface through the tubular string/casing annulus.

Actuators for downhole tools are devices that enable operation of a downhole tool at a targeted interval within the well. A mechanical actuator may be operated by, for example, but not by way of limitation, varying the fluid pressure in the tubular string used to position a downhole tool in the well casing, introducing a ball or dart to sealably engage a seat or receiver in the bore of the tubular string, or by engaging a known downhole structure such as, for example, a liner top to displace an actuator and operate the tool. This latter approach has become disfavored by some operators due to concern that engaging the liner top may result in damage to the liner top or to the cement disposed to surround the liner.

What is needed is a mechanical actuator that can be used to actuate a downhole tool without the necessity of engaging the tool with a liner top or other structure in the well and without the need to introduce a ball or dart that obstructs flow through the tubular string.

BRIEF SUMMARY

One embodiment of the present invention provides an apparatus comprising an elongate mandrel having proximal end, a distal end and a bore therebetween, a slide member surrounding a slide portion of the mandrel, the slide member having a proximal portion, a distal portion and a brush section with a plurality of circumferentially distributed and radially outwardly extending brush elements sized to engage a well casing into which the apparatus is positioned, the slide member being movable along the portion of the mandrel between a proximal position and a distal position, an axially compressible spring element disposed intermediate the slide member and the mandrel to provide a biasing force urging the slide member towards the proximal position and a mechanically actuatable downhole tool coupled to the mandrel and operable from a run-in mode in which the slide member is in the proximal position and an actuated mode in which the slide member is moved to the distal position, wherein movement of the apparatus in a distal direction in the well casing disposes the plurality of brush elements into a trailing up mode and a force imparted to the slide member by frictional engagement of the brush elements with the well casing and the spring element together dispose the slide member in the proximal position, wherein the spring element is selected to have a spring constant that disposes the slide member in the proximal position during movement of the apparatus in a proximal direction in the well casing to dispose the brush elements in a trailing down mode in which the force resulting from frictional engagement of the brush elements with the well casing is insufficient to overcome the biasing force applied by the spring element, and wherein reversing the direction of movement of the apparatus within the well casing from movement in the distal direction to movement in the proximal direction disposes the brush elements in a transition mode providing substantially increased frictional engagement between the brush elements and the well casing that imparts a displacing force on the slide member that is sufficient to overcome the biasing force applied to the slide member by the spring element, thereby resulting in displacement of the slide member from the proximal position to the distal position to actuate the mechanically actuatable downhole tool. The transition mode of the brush elements is that critical point at which the brush elements are deformed as they are being bent by engagement of the brush elements with the well casing as the apparatus begins moving in a proximal direction after sufficient movement in a distal direction to dispose the brush elements in the trailing up mode. Embodiments of the apparatus may include a jet valve as the mechanically actuatable downhole tool, the jet valve being openable to jet fluid provided to a bore of the mandrel from the mandrel with the slide member moved to distal position on the mandrel. In one embodiment of the apparatus, a jet valve that is the actuatable downhole tool can include at least one aperture in the mandrel and at least one aperture in the slide member that is aligned with the at least one aperture of the mandrel with the slide member in the distal position. In another embodiment of the apparatus, the mechanically actuatable downhole tool comprises at least one resiliently deformable packer element that is radially outwardly expandable to a deployed mode to engage and seal between the mandrel and the well casing by movement of the slide member from the proximal position to the distal position, and the at least one resiliently deformable packer element restores to a run-in mode by movement of the slide member from the distal position to the proximal position. In one embodiment of the apparatus, the actuatable downhole tool of the apparatus comprises a plurality of axially aligned resiliently deformable packer elements.

In one embodiment of the apparatus, the slide member includes one of a slot and a protrusion and the mandrel includes the other of the slot and the protrusion to cooperate together to prevent unwanted rotation of the slide member on the mandrel. In one embodiment of the apparatus, the spring element is an axially compressible coil spring surrounding the mandrel. In one embodiment of the apparatus, the mandrel includes an annular recess to receive the spring element. In one embodiment of the apparatus, the brush elements are removably supported on a brush section of the slide member so that the brush elements can be replaced when worn or substituted for varying sizes of well casing.

One embodiment of the apparatus of the present invention includes a mandrel having a proximal end to connect to a tubular string, a distal end, a bore, a distal stop and a proximal stop, a slide member received on a slide portion of the mandrel intermediate the distal stop and the proximal stop, the slide member being reciprocatable on the slide portion of the mandrel between a proximal position, proximal to the proximal stop, and a distal position, proximal to the distal stop, the slide member having a plurality of circumferentially distributed and radially outwardly extending brush elements sized to frictionally engage a well casing in which the apparatus is moved, a spring element disposed intermediate the slide member and the mandrel to bias the slide member towards the proximal position and an actuatable downhole tool connected to the mandrel, the downhole tool being actuated from a first mode to a second mode by displacement of a displaceable member of the downhole tool that is engaged and displaced by movement of the slide member from the proximal positon to the distal position, wherein moving the apparatus in a distal direction in the well casing by extending a tubular string to which the proximal end of the mandrel is connected into the well casing disposes the plurality of brush elements on the slide member in a trailing up mode due to frictional engagement between the plurality of brush elements and the well casing, and wherein moving the apparatus in a proximal direction in the well casing by withdrawing the tubular string to which the proximal end of the mandrel is connected from the well casing disposes the plurality of brush elements on the slide member in a trailing down mode due to frictional engagement between the plurality of brush elements and the well casing and wherein reversing the direction of the mandrel within the well casing from movement in a distal direction to movement in a proximal direction temporarily disposes the plurality of brush elements in a transition mode, intermediate the trailing up mode and the trailing down mode, that provides increased frictional resistance to movement of the slide member with the mandrel and in the proximal direction to impart a downwardly directed force on the slide member relative to the mandrel that is sufficient to compress the spring element and displace the slide member from the proximal position to the distal position to displace the displaceable member of the downhole tool to actuate the downhole tool from a first mode to a second mode. In one embodiment of the apparatus, the actuatable downhole tool is connected to the distal end of the mandrel. In another embodiment of the apparatus of the present invention the actuatable downhole tool comprises at least one resiliently deformable packer element that surrounds the mandrel wherein the at least one resiliently deformable packer element is actuatable from a first mode, with substantially no deformation, to a second mode in which the at least one resiliently deformable packer element is axially compressed and radially expanded to engage the well casing. In another embodiment of the apparatus of the present invention, the actuatable downhole tool comprises a plurality of resiliently deformable packer elements that are aligned along the mandrel. In another embodiment of the apparatus of the present invention, the downhole tool comprises at least one jet valve that is actuatable between a closed first mode and an open second mode wherein pressurized fluid provided to the bore of the mandrel escapes through the at least one jet valve in the second mode to impinge on the well casing. In one embodiment of the apparatus of the present invention, the downhole tool comprises a plurality of circumferentially distributed jet valves. In one embodiment of the apparatus of the present invention, the slide member includes one of a slot and a protrusion and the mandrel includes the other of a slot and a groove to together cooperate to prevent rotation of the slide member on the mandrel. In one embodiment of the apparatus of the present invention, the spring element disposed intermediate the mandrel and the slide member is a coil spring having a bore to surround the mandrel.

One embodiment of the apparatus of the present invention comprises a slide member reciprocatable between a proximal position and a distal position along a slide portion of a mandrel and having a plurality of brush elements thereon, a spring element disposed intermediate the slide member and the mandrel to bias the slide portion to the proximal position and an actuatable downhole tool connected to the mandrel and operable by movement of the slide member from the proximal position to the distal position wherein disposing the brush elements in a transition mode intermediate a trailing up mode and a trailing down mode by reversing the direction of movement of the apparatus within a well casing frictionally engaged by the brush elements provides sufficient displacing force to the slide member to overcome the spring element and move the slide member to the distal position to actuate the actuatable downhole tool.

Embodiments of the apparatus of the present invention can include a variety of actuatable downhole tools. The embodiments of the apparatus disclosed herein is not to be limiting of the adaptation of the brush actuator included in each of the disclosed embodiments to operate other embodiments of the apparatus having other actuatable downhole tools. The brush actuator of embodiments of the apparatus of the present invention presented and disclosed herein can be used with many other and different types of actuatable downhole tools.

DETAILED DESCRIPTION

Figure 1:
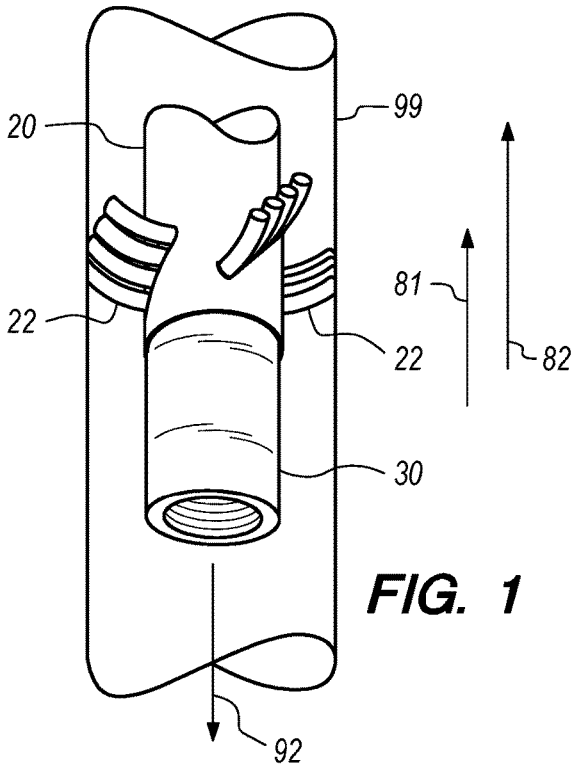
FIG. 1 is an illustration of a portion of a slide member of an embodiment of the apparatus of the present invention having a brush section on which a plurality of brush elements are supported in a trailing up mode.
Figure 2:
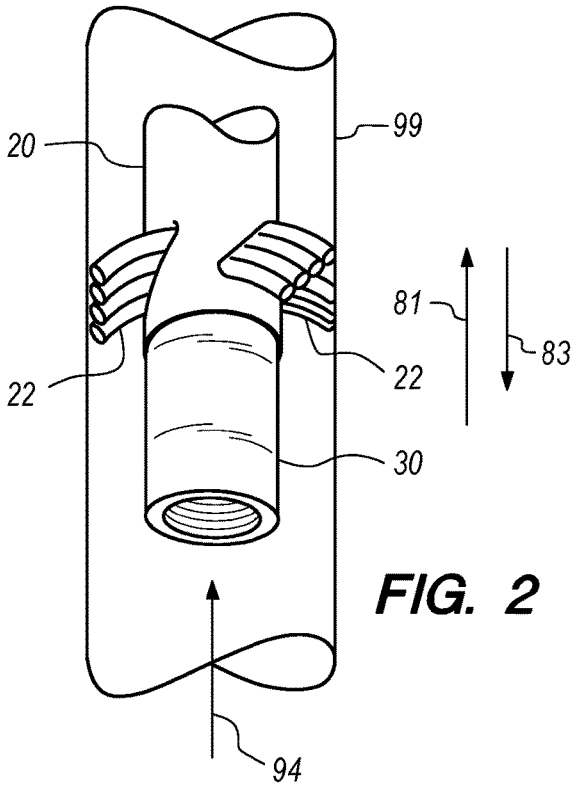
FIG. 2 is an illustration of the portion of the slide member of FIG. 1 with the brush elements supported in a trailing down mode.
Figure 3:
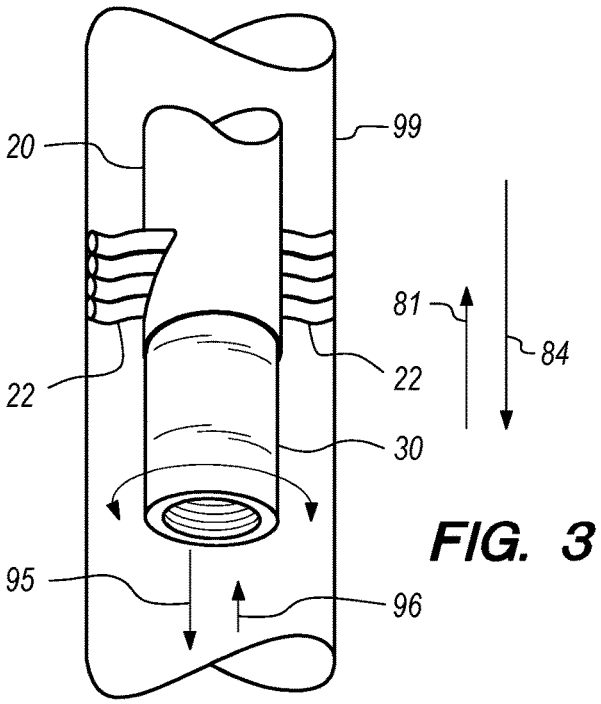
FIG. 3 is an illustration of the brush section 20 of the slide member 30 of FIGS. 1 and 2 in a transition mode, meaning that the brush elements are in a transition mode that is intermediate the trailing up and the trailing down modes illustrated in FIGS. 1 and 2, respectively.

FIGS. 1-3 are free body diagrams illustrating the modes in which the brush elements 22 of the apparatus 10 may be disposed during use embodiments of the apparatus 10 of the present invention and the manner in which the brush element modes can be manipulated to operate the apparatus 10 in a downhole cased environment. It will be understood after the discussion of the various modes in which the brush elements 22 can be disposed that embodiments of the apparatus 10 of the present invention can be manipulated in a manner that enables the operator to control and/or operate the apparatus 10 (not shown in FIGS. 1-3). The length of the arrows 81, 82, 83 and 84 in FIGS. 1-3 indicate the magnitude of the force applied to the slide member 30 by a spring element 40 (spring element 40 not shown in FIGS. 1-3) that biases the slide member 30 towards a proximal position, the magnitude of the force applied to the slide member 30 by the frictional engagement of the brush elements 22 with the casing 99 with the brush elements 22 in a trailing up mode, the magnitude of the force applied by the frictional engagement of the brush elements 22 with the casing 99 with the brush elements 22 in a trailing down mode and the magnitude of the force applied by the frictional engagement of the brush elements 22 with the casing 99 with the brush elements 22 in a transition mode, respectively. It will be understood that the force applied to the slide member 30 by the spring element 40, as indicated by arrow 81, is the same in each of the trailing up, trailing down and transition modes in which the brush elements 22 may be disposed and only the force of the frictional engagement of the brush elements 22 with the casing 99 changes in direction or magnitude, as indicated by the arrows 82, 83 and 84.

FIG. 1 is an illustration of a portion of a slide member 30 of an embodiment of the apparatus 10 of the present invention having a brush section 20 on which a plurality of brush elements 22 are supported in a trailing up mode. The trailing up mode means that the brush elements 22 are in a trailing position as the apparatus 10 (not shown) moves downwardly within the casing 99 in the direction of arrow 92. As the apparatus 10 moves in the direction of arrow 92, the casing 99 imparts an upwardly directed frictional drag force on the brush elements 22 that are supported on the brush section 20 of the slide member 30. The frictional drag force is transferred to the brush section 20 and to the slide member 30 to which the brush section 20 is connected to impart an upwardly directed force indicated by arrow 82 on the brush section 20 and the slide member 30. The frictional drag force imparted to the brush section 20 and the slide member 30 of the apparatus 10 (not shown) indicated by the arrow 82 is in the same direction as a force applied by a spring element 40 (not shown) of the apparatus 10 and indicated by arrow 81. FIG. 1 illustrates that, when the brush elements 22 are disposed in the trailing up mode, the resulting force applied to the brush section 20 and the connected slide member 30 as a result of the movement of the apparatus 10 in the downwardly direction indicated by the arrow 92 complements the force applied by the spring element 40 (not shown in FIG. 1). The result is that the slide member 30 remains firmly in a proximal position on the apparatus 10, and that an actuatable downhole tool (not shown in FIG. 1) that is part of the apparatus 10 remains unactuated.

FIG. 2 is an illustration of the portion of the slide member 30 of FIG. 1 with the brush elements 22 supported in a trailing down mode. The trailing down mode means that the brush elements 22 are in a trailing position as the apparatus 10 (not shown) moves upwardly within the casing 99 in the direction of arrow 94. As the apparatus 10 moves in the direction of arrow 94, the casing 99 imparts a downwardly directed frictional drag force on the brush elements 22 that are supported on the brush section 20 of the slide member 30. The frictional drag force imparted to the brush section 20 and the slide member 30 of the apparatus 10 (not shown) indicated by the arrow 83 is in the opposite direction from the force applied by a spring element 40 (not shown) of the apparatus 10 and indicated by arrow 81. FIG. 2 illustrates that, when the brush elements 22 are disposed in the trailing down mode, the resulting force applied to the brush section 20 and the connected slide member 30 as a result of the movement of the apparatus 10 in the upwardly direction indicated by the arrow 94 opposes the force applied by the spring element 40 (not shown in FIG. 1), but the force applied to the brush section 20 and the connected slide member 30 as a result of the movement of the apparatus 10 in the upwardly direction indicated by the arrow 94 is less in magnitude than the opposing force applied to the slide member 30 by the spring element 40 (not shown). The result is that the slide member 30 remains in the proximal position on the apparatus 10, and that an actuatable downhole tool (not shown in FIG. 2) that is part of the apparatus 10 remains unactuated.

FIG. 3 is an illustration of the brush section 20 of the slide member 30 of FIGS. 1 and 2 in a transition mode, meaning that the brush elements 22 are in a transition mode that is intermediate the trailing up and the trailing down modes illustrated in FIGS. 1 and 2, respectively. The transition mode of the brush elements 22 illustrated in FIG. 3 may be described as an intermediate mode in which the brush elements 22 are disposed in a bind. The transition mode of the brush elements 22 is achieved by first moving the apparatus 10 downwardly in the direction indicated by the arrow 95 to dispose the brush elements 22 in a trailing up mode (illustrated in FIG. 1) and by then reversing the movement through a very small interval of upwardly movement of the apparatus 10 in the direction indicated by the arrow 96 to dispose the brush elements 22 in the transition mode illustrated in FIG. 3. It will be noted that the arrow 95 is long to illustrate that the downwardly directed movement to dispose the brush elements 22 in the trailing up mode is a relatively long movement and to illustrate that the upwardly directed movement needed to dispose the brush elements 22 in the transition mode is a relatively short interval. It will be understood that the actual interval over which the apparatus 10 must be moved upwardly (after the brush elements 22 are first disposed in the trailing up mode by downward movement) to dispose the brush elements 22 in the transition mode is determined by several factors including, but not limited to, the diameter of the casing 99, the length, gauge and stiffness of the brush elements 22, the diameter of the brush section 20 of the slide member 30 and the roughness (or smoothness) of the casing 99. In the transition mode illustrated in FIG. 3, the frictional engagement between the brush elements 22 and the casing 99 results a downwardly directed displacing force on the brush section 20 and the slide member 30 to which the brush section 20 is connected. The downwardly directed displacing force imparted to the slide member 30, indicated by arrow 84, is greater in magnitude than the upwardly directed force imparted to the slide member 30 by the spring element 40 (not shown in FIG. 3) as indicated by arrow 81. The result is that the slide member 30 is displaced from the proximal position (illustrated in FIG. 4) to the distal position (illustrated in FIG. 5) on the apparatus 10. This transition mode illustrated in FIG. 3 enables an apparatus 10 having a brush actuator that includes the brush section 20, slide member 30 and brush elements 22 as indicated in FIGS. 1-3 to be used to selectively and repeatedly actuate an actuatable downhole tool, as discussed in further detail below.

Figure 4:
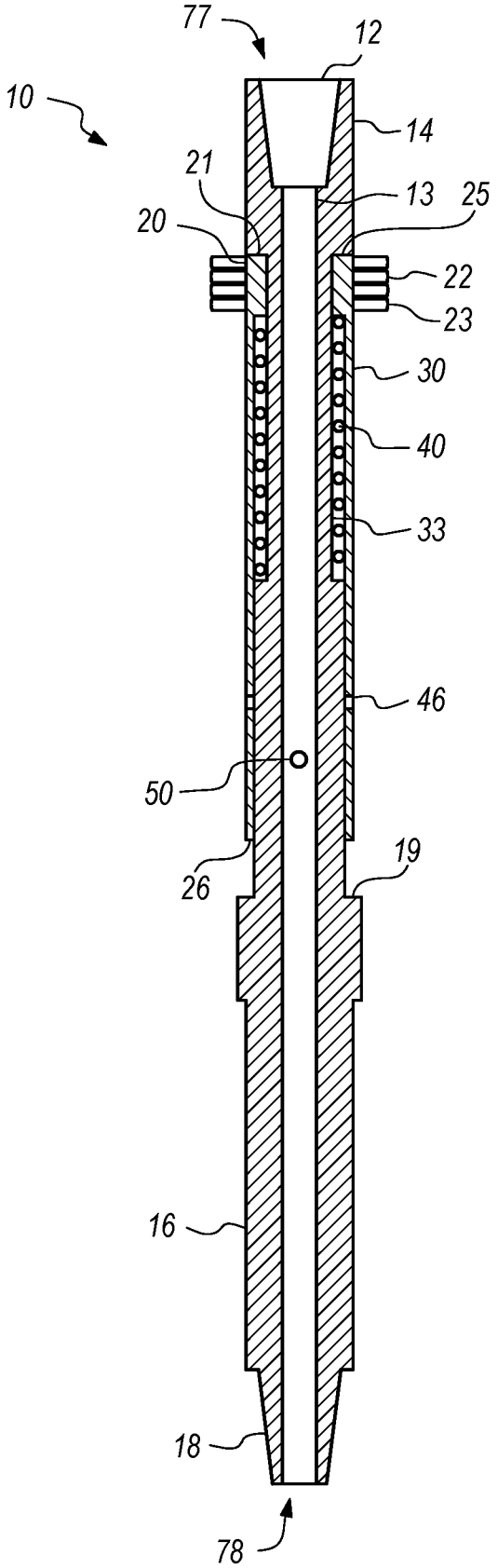
FIG. 4 is a sectioned elevational view of an embodiment of an apparatus including an actuatable downhole tool that can be actuated using a brush actuator in the manner illustrated in FIGS. 1-3.

Before leaving FIG. 3, it is important to note that the brush elements 22 can be removed from the transition mode illustrated in FIG. 3 to restore the slide member 30 to the proximal position shown in FIG. 4 by movement of the apparatus 10 upwardly within the casing 99 thereby causing the brush elements 22 to leave the transition mode and to enter the trailing down mode illustrated in FIG. 1, by movement of the apparatus 10 downwardly within the casing 99 thereby causing the brush elements 22 to leave the transition mode and to enter the trailing up mode illustrated in FIG. 2, or by rotation of the apparatus 10 within the casing 99, either clockwise or counterclockwise, to cause the brush elements 22 to enter into one of two possible circumferentially trailing modes. Any of these actions will cause the brush elements 22 to leave the transition mode and the force applied by the spring element 40 to the slide member 30 will restore the slide member 30 to a proximal position on the apparatus 10. Given the conventional direction of threads used in oilfield tubulars, rotation of the tubular string that is used to position and to move the apparatus 10 within the casing 99, a clockwise rotation is the preferred rotation for removing the brush elements 22 from the transition mode and for restoring the apparatus 10 from the actuated mode to the run-in mode.

Figure 5:
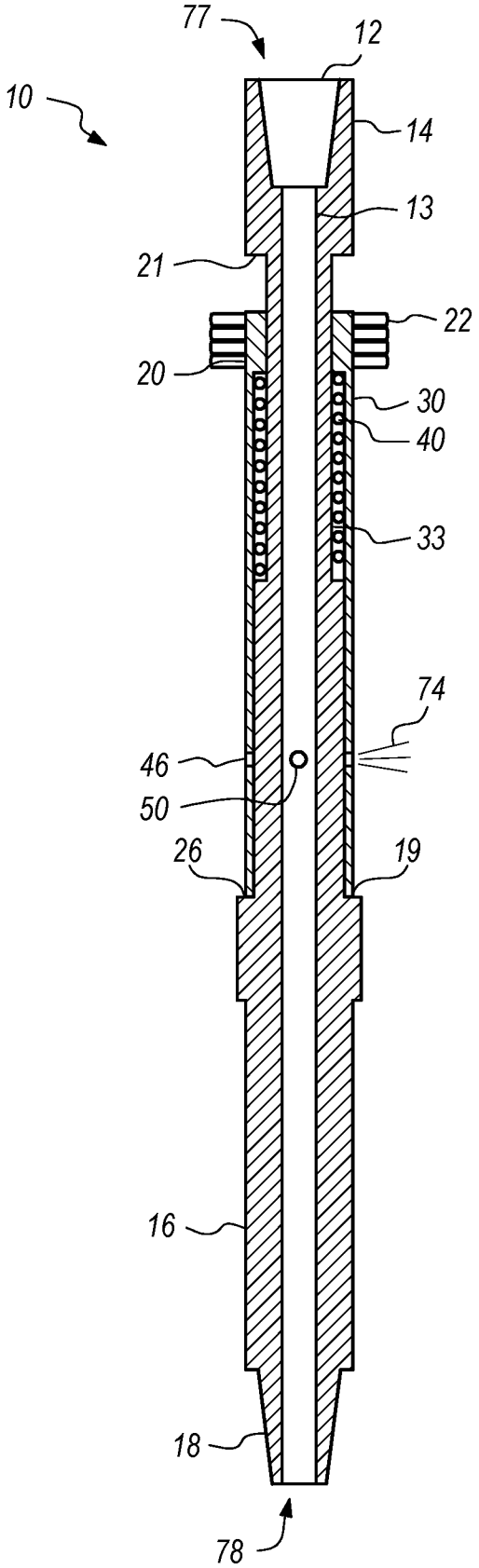
FIG. 5 is the sectioned elevational view of the apparatus of FIG. 4 after the apparatus is manipulated to actuate the downhole jetting tool to which the brush actuator is connected.

FIG. 4 is a sectioned elevational view of an embodiment of an apparatus 10 including an actuatable downhole tool that can be actuated using a brush actuator in the manner illustrated in FIGS. 1-3. FIG. 5 is the sectioned elevational view of the apparatus 10 of FIG. 4 after the apparatus 10 is manipulated to actuate the downhole jetting tool to which the brush actuator is connected. Although the embodiment of the apparatus 10 of the present invention in FIG. 4 is not shown disposed within a casing 99, the brush elements 22 on the slide member 30 of the apparatus 10 may, when disposed within the casing 99, comform to the illustrations of either of FIGS. 1 and 2 which demonstrate the trailing up and trailing down modes, respectively. In the embodiment of the apparatus 10 of FIG. 4, the actuatable downhole tool comprises a jet tool having a jet valve that can be opened to jet high velocity streams of a fluid, such as water or solvents, onto the casing 99 (not shown in FIG. 4) to clean the casing 99 or to clean out clogged or caked perforations or other downhole structures.

The embodiment of the apparatus 10 of FIG. 4 includes a tubular mandrel 14 having a proximal end 12 and a distal end 18, a slide member 30 received to surround the mandrel 14 and movable between a proximal position, illustrated in FIG. 4, and a distal position illustrated in FIG. 5. The slide member 30 of the apparatus 10 of FIG. 4 includes a brush section 20 on which a plurality of brush elements 22 are radially outwardly supported, a proximal end 25 and a distal end 26. The brush elements 22 may be bundles of bristles 23 that are bound together in groups of bristles 23 to form a brush element 22, The bristles 23 may comprise stiff steel wires, each having a common length and being supported on the brush section 20 of the slide member 30 to extend radially outwardly from the brush section 20 of the slide member 30 to engage and abrade the casing 99 (not shown in FIG. 4—see FIGS. 1-3). The mandrel 14 of the apparatus 10 of FIG. 4 further includes a distal stop 19, a bore 78, a proximal stop 21 and a slide section 31 disposed intermediate the proximal stop 21 and the distal stop 19 along which the slide member 30 reciprocates as it moves from a run-in mode illustrated in FIG. 4 to an actuated mode illustrated in FIG. 5. A spring element 40 is disposed intermediate the slide member 30 and the mandrel 14 to bias the slide member 30 away from the actuated mode illustrated in FIG. 5 and towards the run-in mode illustrated in FIG. 4. The distal end 26 of the slide member 30 may engage the distal stop 19 on the mandrel 14 with the slide member 30 disposed in the distal position illustrated in FIG. 5 and the proximal end 25 of the slide member 30 may engage the proximal stop 21 of the mandrel 14 with the slide member 30 of the apparatus 10 disposed in the proximal position illustrated in FIG. 4. The mandrel 14 may include a stabilizer 27 along an outer surface 16 of the mandrel 14 to isolate engagement between the slide member 30 and the casing 99 (not shown in FIGS. 4 and 5) to the brush elements 22 supported on the brush section 20 of the slide member 30.

The slide member 30 of the apparatus 10 of FIG. 4 further includes a plurality of circumferentially distributed apertures 46. The mandrel 14 of the apparatus 10 of FIG. 4 includes a plurality of circumferentially distributed apertures 50. In the run-in mode of the apparatus 10 indicated in FIG. 4, the slide member 30 is in the proximal position and the plurality of apertures 46 in the slide member 30 are not aligned with the plurality of apertures 50 in the mandrel 14. No fluid can be jetted through the plurality of apertures 46 of the slide member 30 or through the apertures 50 of the mandrel 14 in the run-in mode of the apparatus 10 illustrated in FIG. 4.

FIG. 5 is the perspective view of the apparatus 10 of FIG. 4 after the apparatus 10 is manipulated within a casing 99 (not shown in FIG. 5—see FIG. 3) to actuate the downhole jetting tool to which the brush actuator is connected. Although the embodiment of the apparatus 10 of the present invention in FIG. 5 is not shown disposed within a casing 99, the brush elements 22 on the slide member 30 of the apparatus 10 may, when disposed within the casing 99, comform to the illustration of FIG. 3 which demonstrates the transition mode of the brush elements 22 in which the actuatable downhole tool of the apparatus 10 is actuated. FIG. 5 illustrates the alignment of the plurality of apertures 46 in the downwardly displaced slide member 30 with the corresponding plurality of apertures 50 of the mandrel 14 to open the jetting valve formed by the plurality of apertures 46 of the slide member 30 and plurality of apertures 50 of the mandrel 14. A jet spray 74 is produced at each set of aligned apertures 46 and 50 to impinge upon the casing 99 (not shown).

Figure 6:
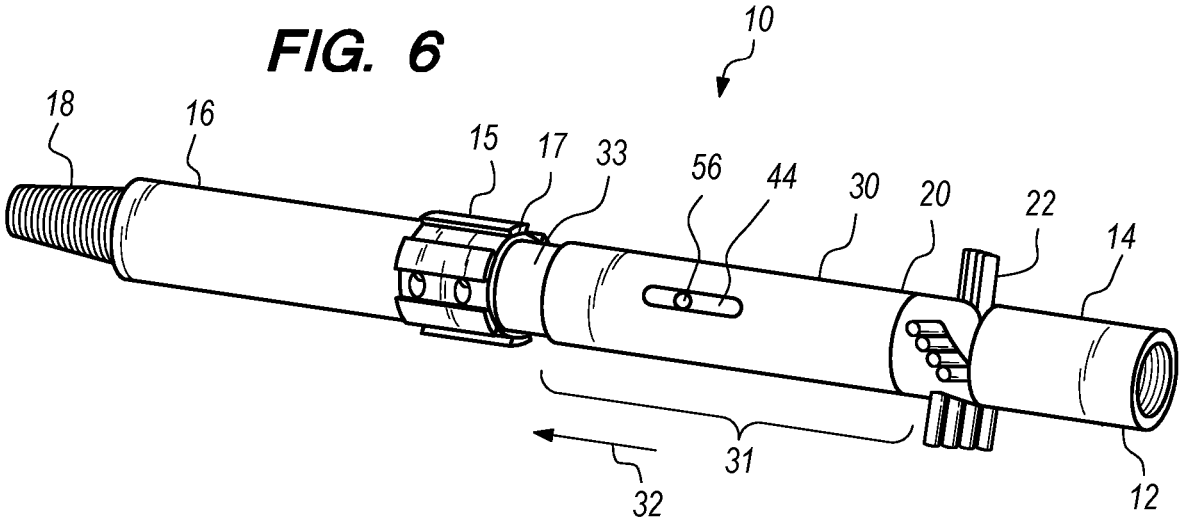
FIG. 6 is a perspective view of the embodiment of the apparatus of FIG. 4.

FIG. 6 is a perspective view of the embodiment of the apparatus 10 of FIG. 4. The spring element 40 that is disposed intermediate the slide member 30 and the mandrel 14 cannot be seen in FIG. 6. The stabilizer 15 is adapted to provide stand-off from the casing 99 (not shown) while permitting annular flow. The brush elements 22 are shown in an optional arrangement in which each brush element 22 is circumferentially offset from an adjacent brush element 22. The slide section 31 of exterior surface 16 of the mandrel 14, along which the slide member 30 can be moved, is shown in FIG. 6. A protrusion 56 is shown as being fixed to the mandrel 14 and received within a slot 44 in the slide member 30 to prevent rotation of the slide member 30 on the mandrel 14. It will be understood that the slide member 30 can move axially along the mandrel 14 within the slide section 31 as permitted by the slot 44 alignment, but the slide member 30 is restrained from rotation on the mandrel 14 by the slot 44 and protrusion 56. Actuation of the embodiment of the apparatus 10 of FIG. 6 moves the slide member 30 away from the proximal end 12 of the mandrel 14 and towards the distal end 18 of the mandrel 14 in the direction of arrow 32.

Figure 7:
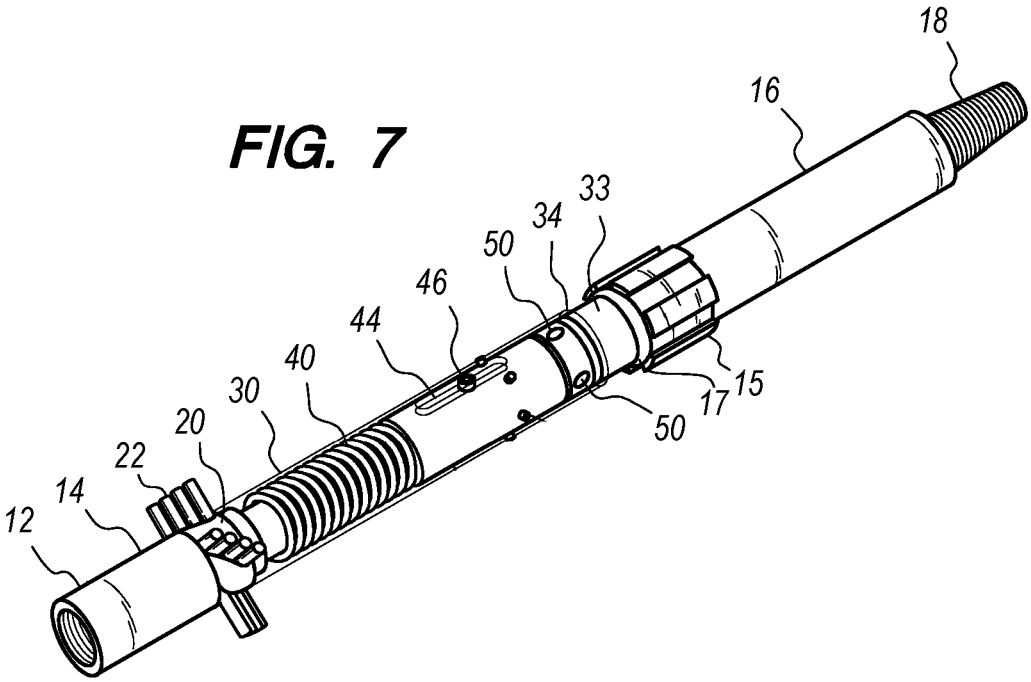
FIG. 7 is a perspective view of the apparatus of FIG. 6 with the slide member illustrated as transparent to reveal the spring element disposed intermediate the mandrel and the slide member to bias the slide member and the brush section thereof towards the proximal position on the apparatus.

FIG. 7 is a perspective view of the apparatus 10 of FIG. 6 with the slide member 30 illustrated as transparent to reveal the spring element 40 disposed intermediate the mandrel 14 and the slide member 30 to bias the slide member 30 and the brush section 20 thereof towards the proximal position on the apparatus 10. FIG. 7 illustrates a distal end 17 of the slide member 30 that engages the stop wall 17 of the stabilizer 15 upon displacement of the slide member 30 to the distal position. In FIG. 2, it can be seen that the slide member 30 is in the proximal position and there is an exposed portion of the mandrel 33 between the distal end 34 of the slide member 30 and the stop wall 17 of the stabilizer 15.

Figure 8:
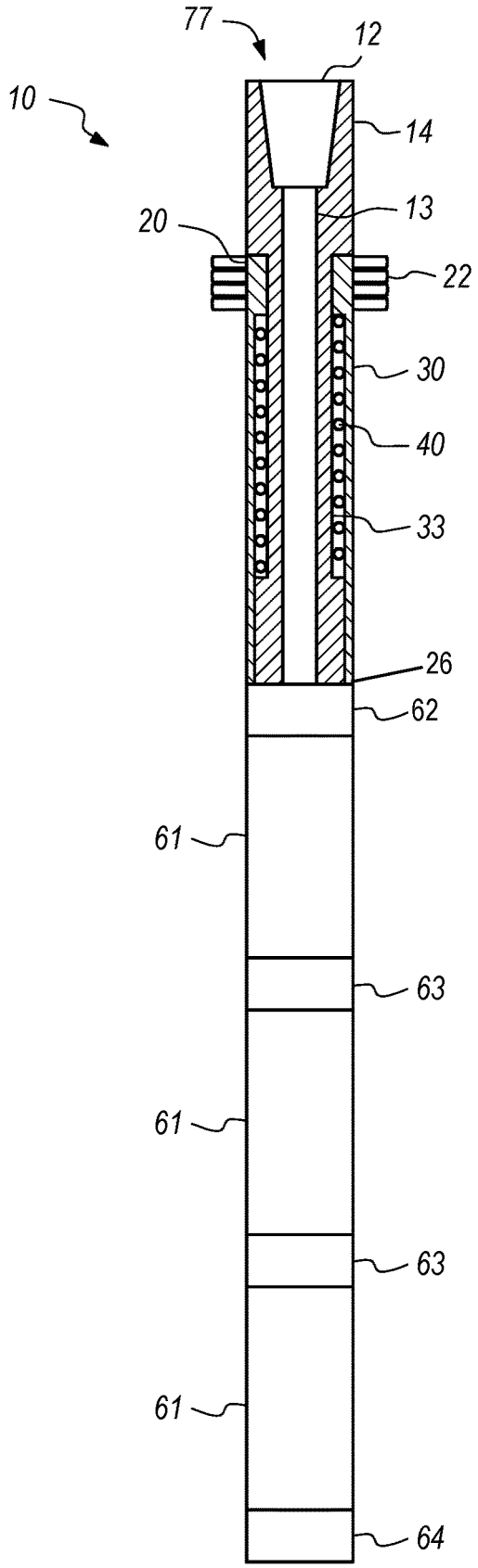
FIG. 8 is a partially sectioned elevational view of an embodiment of an apparatus of the present invention having a mandrel with a proximal end, a distal end and a bore extending therethrough.
Figure 9:
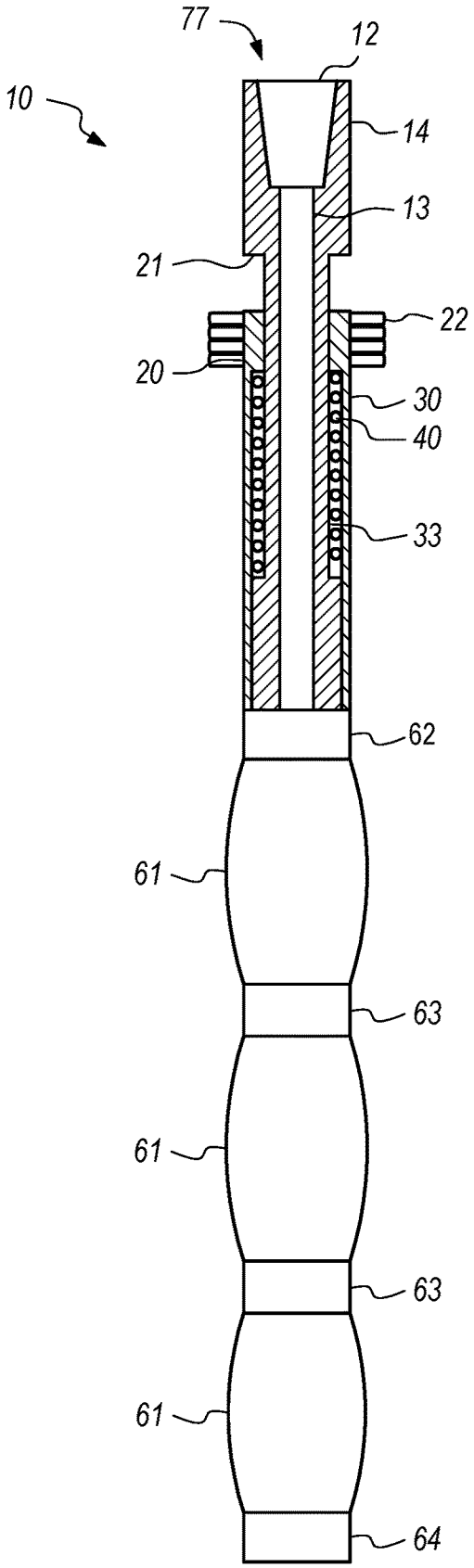
FIG. 9 is the partially sectioned view of the embodiment of the apparatus of FIG. 8 after the slide member is displaced downwardly relative to the mandrel by disposing the brush elements into engagement with a well casing (not shown) and by disposing the brush elements in the transition mode to displace the slide member (see FIG. 3).

FIGS. 8 and 9 illustrate an embodiment of the apparatus 10 comprising a deployable packer element. These drawings illustrate the adaptability of the apparatus 10 of the present invention for use with various actuatable downhole tools.

FIG. 8 is a partially sectioned elevational view of an embodiment of an apparatus 10 of the present invention having a mandrel 14 with a proximal end 12, a distal end 64 and a bore 13 extending therethrough. The apparatus 10 of FIG. 8 further includes a slide member 30 reciprocatably received to surround the mandrel 14, the slide member 30 having a brush section 20 and a plurality of circumferentially distributed brush elements 22 supported on the brush section 20 of the slide member 30 to extend radially outwardly from the slide member 30 to engage a casing 99 (not shown in FIG. 8) into which the apparatus 10 may be disposed. The proximal end 12 of the mandrel 14 includes threads 77 for coupling the apparatus 10 to a tubular string (not shown) that can be used to position and move the apparatus 10 within a cased well. The apparatus 10 further includes a spring element 40 disposed intermediate the slide member 30 and the mandrel 14 to bias the slide member 30 towards a proximal position on the mandrel 14 illustrated in FIG. 8. The spring element 40 of the apparatus 10 of FIG. 8 is illustrated as being received into an annular recess 33 formed in the mandrel 14.

The apparatus 10 of FIG. 8 further includes a plurality of resiliently compressible packer elements 61 that are coupled to surround the mandrel 14 intermediate the proximal end 12 and the distal end 64. The packer elements 61 are axially compressible to produce a radially outwardly expanded configuration that will be discussed in connection with FIG. 9. In the embodiment of the apparatus 10 of FIG. 8, the plurality of packer elements 61 are disposed on the mandrel 14 intermediate an end ring 62 and the distal end 64 of the mandrel 14. The end ring 62 is engaged by the distal end 26 of the slide member 30. In the embodiment of the apparatus 10 of FIG. 8, there are three packer elements 61, each separated from at least one adjacent packer element 61 by an intermediate ring 63.

FIG. 9 is the partially sectioned view of the embodiment of the apparatus 10 of FIG. 8 after the slide member 30 is displaced downwardly relative to the mandrel 14 by disposing the brush elements 22 into engagement with a well casing 99 (not shown) and by disposing the brush elements 22 in the transition mode to displace the slide member 30 (see FIG. 3). The end ring 62 is displaced downwardly by the slide member 30 to axially compress and to radially outwardly expand the plurality of packer elements 61 to engage and seal with the casing 99 (not shown).

In some embodiments of the apparatus 10 of the present invention, the seal(s) between the radially expanded plurality of packer elements 61 and the casing 99 (not shown) into which the apparatus 10 is disposed enables a section of casing 99 below the plurality of packer elements 61 to be pressure tested by providing pressurized fluid into the tubular string (not shown) connected to the proximal end 12 of the mandrel 14 of the apparatus 10. Embodiments of the apparatus 10 of the present invention may also be used to pressure test by providing pressurized fluid into the annulus (not shown) radially intermediate the tubular string (not shown) and the casing 99 (not shown) of the well. Embodiments of the apparatus of the present invention 10 may be used to ensure that well treatment fluids such as, for example, acids, can be injected through targeted casing 99 perforations and into subsurface geologic formations for increased production through stimulation. It will be understood that embodiments of the apparatus 10 of the present invention can be used in other ways to test, stimulate or service wells.

Figure 10:
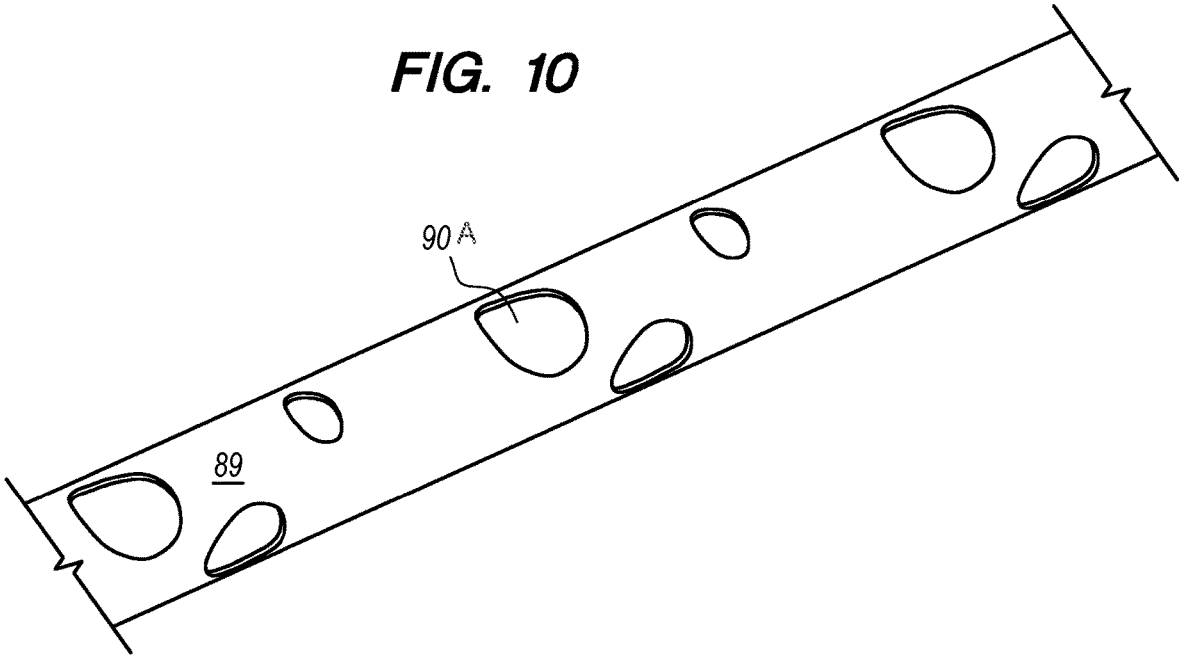
FIG. 10 is a perspective view of a section of a perforating gun cover having a plurality of ports therein.

FIG. 10 is a perspective view of a section of a perforating gun cover 89 having a plurality of ports 90A therein. The perforating gun cover 89 can be movably disposed on a perforating gun (not shown in FIG. 10) having a plurality of explosive chemical charges 90B (not shown in FIG. 10) along its length, the perforating gun cover 89 being movable from a run-in mode, in which the explosive chemical charges 90B along the perforating gun are covered and protected against fouling by well fluids, to a detonation mode in which the explosive charges along the perforating gun are exposed for detonation.

Figure 11:
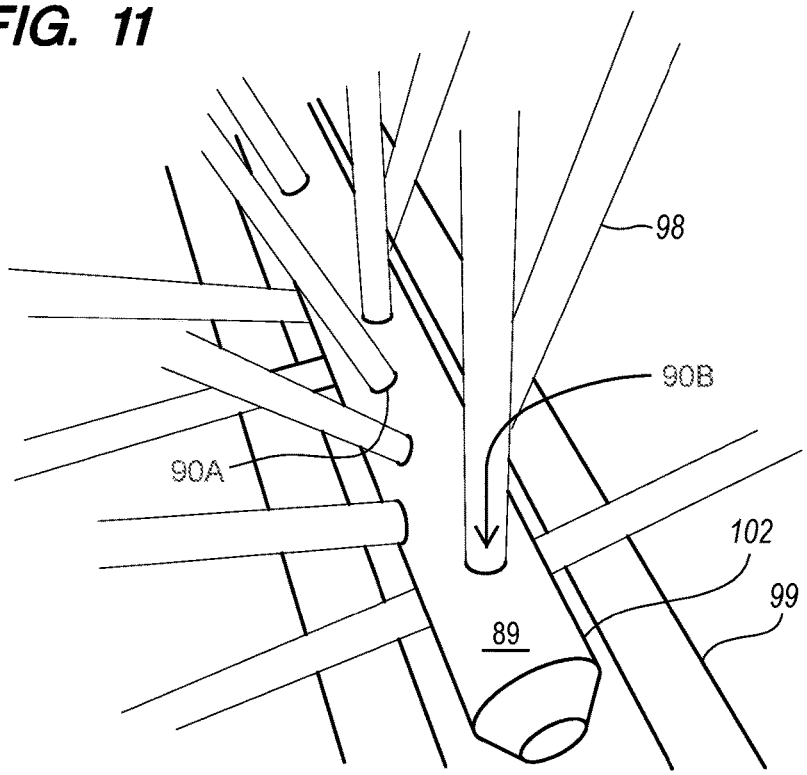
FIG. 11 is a perspective view of a perforating gun having the perforating gun cover of FIG. 10 in the detonation mode to allow the unfouled explosive chemical charge to detonate and blast perforations into the surrounding formation.

FIG. 11 is a perspective view of a perforating gun 102 having the perforating gun cover 89 of FIG. 10 in the detonation mode to allow the unfouled explosive chemical charges 90B to detonate and blast perforations 98 into the surrounding formation.

It will be understood that the spring element 40, illustrated in the appended figures as a coil spring, may be other types of spring elements including, but not limited to, a spring element having a volume of a compressible gas or elastically deformable elements. It will be understood that the slide member 30 and the support collar 20 may, in some embodiments, be connected one to the other and, in other embodiments, the slide member 30 and the support collar 20 may be integral one with the other. The brush elements 22 of the brush tool 10 are preferably releasably coupled to the support collar 20 of the brush tool 10, but may also be integrally connected.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An apparatus, comprising:

an elongate mandrel having proximal end, a distal end and a bore therebetween;

a slide member surrounding a portion of the mandrel, the slide member having a proximal portion, a distal portion and a brush section with a plurality of circumferentially distributed and radially outwardly extending brush elements sized to engage a well casing into which the apparatus is positioned, the slide member being movable along a portion of the mandrel between a proximal position and a distal position;

an axially compressible spring element disposed intermediate the slide member and the mandrel to provide a biasing force urging the slide member towards the proximal position; and a mechanically actuatable downhole tool coupled to the mandrel and operable from a run-in mode in which the slide member is in the proximal position and an actuated mode in which the slide member is moved to the distal position;

wherein movement of the apparatus in a distal direction in the well casing disposes the plurality of brush elements into a trailing up mode and a force imparted to the slide member by frictional engagement of the brush elements with the well casing and the spring element together dispose the slide member in the proximal position;

wherein the spring element is selected to have a spring constant that disposes the slide member in the proximal position during movement of the apparatus in a proximal direction in the well casing to dispose the brush elements in a trailing down mode in which the force resulting from frictional engagement of the brush elements with the well casing is insufficient to overcome the biasing force applied by the spring element;

wherein reversing the direction of movement of the apparatus within the well casing from movement in the distal direction to movement in the proximal direction disposes the brush elements in a transition mode providing substantially increased frictional engagement between the brush elements and the well casing that imparts a displacing force on the slide member that is sufficient to overcome the biasing force applied to the slide member by the spring element, thereby resulting in displacement of the slide member from the proximal position to the distal position to actuate the mechanically actuatable downhole tool.

2. The apparatus of claim 1, wherein the mandrel includes a slide section along which the slide member is moved.

3. The apparatus of claim 1, wherein the mechanically actuatable downhole tool comprises a jet valve that is opened to jet fluid from the mandrel with the slide member in the distal position on the mandrel.

4. The apparatus of claim 3, wherein the jet valve includes at least one aperture in the mandrel and at least one aperture in the slide member that is aligned with the at least one aperture of the mandrel with the slide member in the distal position.

5. The apparatus of claim 1, wherein the mechanically actuatable downhole tool comprises at least one resiliently deformable packer element that is radially outwardly expandable to a deployed mode to engage and seal between the mandrel and the well casing by movement of the slide member from the proximal position to the distal position; and wherein the at least one resiliently deformable packer element restores to a run-in mode by movement of the slide member from the distal position to the proximal position.

6. The apparatus of claim 5, wherein the at least one resiliently deformable packer elements comprises a plurality of axially aligned resiliently deformable packer elements.

7. The apparatus of claim 1, wherein the slide member includes one of a slot and a protrusion and the mandrel includes the other of the slot and the protrusion to prevent rotation of the slide member on the mandrel.

8. The apparatus of claim 1, wherein the spring element is an axially compressible coil spring surrounding the mandrel.

9. The apparatus of claim 1, wherein the mandrel includes an annular recess to receive the spring element.

10. The apparatus of claim 1, wherein the brush elements are removably supported on the brush section of the slide member.

11. An apparatus, comprising:

a mandrel having a proximal end to connect to a tubular string, a distal end, a bore, a distal stop and a proximal stop;

a slide member received on a slide portion of the mandrel intermediate the distal stop and the proximal stop, the slide member being reciprocatable on the slide portion of the mandrel between a proximal position, proximal to the proximal stop, and a distal position, proximal to the distal stop, the slide member having a plurality of circumferentially distributed and radially outwardly extending brush elements sized to frictionally engage a well casing in which the apparatus is moved;

a spring element disposed intermediate the slide member and the mandrel to bias the slide member towards the proximal position; and an actuatable downhole tool connected to the mandrel, the downhole tool being actuated from a first mode to a second mode by displacement of a displaceable member of the downhole tool that is engaged with and displaced by movement of the slide member from the proximal position to the distal position;

wherein moving the apparatus in a distal direction in the well casing by extending the tubular string to which the proximal end of the mandrel is connected into the well casing disposes the plurality of brush elements on the slide member in a trailing up mode due to frictional engagement between the plurality of brush elements and the well casing; and wherein moving the apparatus in a proximal direction in the well casing by withdrawing the tubular string to which the proximal end of the mandrel is connected from the well casing disposes the plurality of brush elements on the slide member in a trailing down mode due to frictional engagement between the plurality of brush elements and the well casing; and wherein reversing a direction of the mandrel within the well casing from movement in a distal direction to movement in a proximal direction temporarily disposes the plurality of brush elements in a transition mode, intermediate the trailing up mode and the trailing down mode, that provides increased frictional resistance to movement of the slide member with the mandrel and in the proximal direction to impart a downwardly directed force on the slide member relative to the mandrel that is sufficient to compress the spring element and displace the slide member from the proximal position to the distal position to displace the displaceable member of the downhole tool to actuate the downhole tool from a first mode to a second mode.

12. The apparatus of claim 11, wherein the actuatable downhole tool is connected to the distal end of the mandrel.

13. The apparatus of claim 11, wherein the actuatable downhole tool comprises at least one resiliently deformable packer element that surrounds the mandrel.

14. The apparatus of claim 13, wherein the at least one resiliently deformable packer element is actuatable from a first mode, with substantially no deformation, to a second mode in which the at least one resiliently deformable packer element is axially compressed and radially expanded to engage the well casing.

15. The apparatus of claim 14, wherein the actuatable downhole tool comprises a plurality of resiliently deformable packer elements that are aligned along the mandrel.

16. The apparatus of claim 11, wherein the downhole tool comprises at least one jet valve that is actuatable between a closed first mode and an open second mode;

wherein pressurized fluid provided to the bore of the mandrel escapes through the at least one jet valve in the second mode to impinge on the well casing.

17. The apparatus of claim 16, wherein the downhole tool comprises a plurality of circumferentially distributed jet valves.

18. The apparatus of claim 11, wherein the slide member includes one of a slot and a protrusion and the mandrel includes the other of a slot and a protrusion to together cooperate to prevent rotation of the slide member on the mandrel.

19. The apparatus of claim 11, wherein the spring element disposed intermediate the mandrel and the slide member is a coil spring having a bore to surround the mandrel.

20. An apparatus, comprising:

a slide member reciprocatable between a proximal position and a distal position along a slide portion of a mandrel and having a plurality of brush elements thereon;

a spring element disposed intermediate the slide member and the mandrel to bias the slide portion to the proximal position; and an actuatable downhole tool connected to the mandrel and operable by movement of the slide member from the proximal position to the distal position;

wherein disposing the brush elements in a transition mode intermediate a trailing up mode and a trailing down mode by reversing the direction of movement of the apparatus within a well casing frictionally engaged by the brush elements provides sufficient displacing force to the slide member to overcome the spring element and move the slide member to the distal position to actuate the actuatable downhole tool.

* * * * *